United States Patent [19]

Buss et al.

[11] 4,076,960

[45] Feb. 28, 1978

[54] CCD SPEECH PROCESSOR

[75] Inventors: Dennis D. Buss; Charles Robert Hewes, both of Richardson, Tex.

[73] Assignee: Texas Instruments Incorporated, Dallas, Tex.

[21] Appl. No.: 735,916

[22] Filed: Oct. 27, 1976

[51] Int. Cl.[2] ..... G10L 1/00

[52] U.S. Cl. ..... 179/1 SA

[58] Field of Search ..... 179/1 SA, 1 SC

[56] References Cited

U.S. PATENT DOCUMENTS

| | | | |
|---|---|---|---|
| 3,681,530 | 8/1972 | Manley et al. | 179/1 SA |
| 3,715,512 | 2/1973 | Kelly | 179/1 SA |

OTHER PUBLICATIONS

J. Flanagan, "Speech Analysis, Synthesis and Perception," Springer-Verlag, 2nd Ed., 1972, pp. 175, 184, 361.

J. Markhoul, "Spectral Analysis of Speech," IEEE Trans. on Audio, vol. 21, No. 3, Jun. 1973.

*Primary Examiner*—Kathleen H. Claffy
*Assistant Examiner*—E. S. Kemeny
*Attorney, Agent, or Firm*—James T. Comfort; Charles J. Fassbender; William E. Hiller

[57] ABSTRACT

Homomorphic speech processing apparatus utilizing CCD implementation of the CZT algorithm for performing DFT and IDFT operations in extracting representations of formants and/or pitch data from sampled speech inputs. Embodiments also are described for performing the DFT and IDFT operations (a) by generating n-transforms and averaging the result and (b) for performing a sliding CZT transform. In a further embodiment, a smoothed spectrum of vocal tract data is obtained using a CCD filter with a low pass response. The CCD implementation includes transversal filters employing split-electrode signal amplitude weighting.

28 Claims, 28 Drawing Figures

Fig. 2e (ACTUAL PHOTO)

Fig. 2f (PHOTO ON EXPANDED SCALE)

CCD SPEECH PROCESSOR

BACKGROUND OF THE INVENTION

This invention relates to speech processors, and more particularly to analog speech processors which are implemented with charge coupled devices (CCDs). The CCD speech processors have several applications. They may be used, for example, in speech recognition systems. Such a system may function to recognize the voice of particular speakers, and as such may be used as a security device. As another example, a speech recognition system may be used to first recognize spoken words, and then to translate them into digitally encoded form which can be operated on by a machine. Speech processors are also used as data compressors. It is well known that speech waveforms contain much redundant information. A speech processor may be used to eliminate this redundancy, and thereby achieve a significant bandwidth reduction from the original speech signals.

Several approaches have been used in the past to physically construct speech processors. Many of these methods are described in an article by White, in the May 1976 issue of "Computer" at pp. 40–52. One of the most important of these methods is called linear predictive coding (LPC). This method is described in an article by J. Makhoul entitled "Spectral Analysis of Speech by Linear Prediction", in the 1973 IEEE Transactions on Audio Electroacoustics, Vol. AU-21, at pp. 140–148. Basically, linear predictive coding is a digital method of analyzing speech. One problem, however, with this approach is that it requires some complex mathematical operations to be performed, which are expensive to implement with today's digital technology. As such, the method becomes impractical for many low cost applications.

Accordingly, it is one object of this invention to provide relatively low cost CCD speech processor.

Another objective of the invention is to provide a CCD speech processor which operates directly on analog signals representing the speech waveforms.

SUMMARY OF THE INVENTION

These and other objectives are accomplished in accordance with the invention by a homomorphic deconvolution apparatus for speech processing. The apparatus comprises a first charge coupled device CZT filter for performing spectral analysis on a speech sample input thereto and produces a first output signal representing the power spectrum of the speech sample input. A non-linear response signal amplituding device is connected to the first filter for producing an output signal comprising a non-linear magnitude of the spectrum of the speech sample input. Additional signal processing devices including at least one further charge coupled device filter is connected to receive the magnitude output signals and produce data representing formants and/or pitch data from the magnitude output signal.

In one particular embodiment, the additional signal processing devices comprise a charge coupled device inverse CZT filter connected to receive said magnitude signal and produce a cepstrum data output signal, and another device is connected to gate a timed portion of the output signal from the inverse CZT filter to provide an input to second charge coupled device CZT filter for producing an output signal representing vocal tract data from the magnitude output signal.

In another particular embodiment, the additional signal processing devices comprise a charge coupled device low pass filter connected to receive and filter the magnitude output signal to produce a smoothed spectrum of vocal tract data from the magnitude output signal. Variations of each of the above embodiments are also disclosed wherein each embodiment is primarily comprised of novel CCD filters.

BRIEF DESCRIPTION OF THE DRAWINGS

For a more detailed description of illustrative features of the invention, several embodiments thereof will be described in further detail, by way of example, with reference to the drawings wherein.

Figure 1:
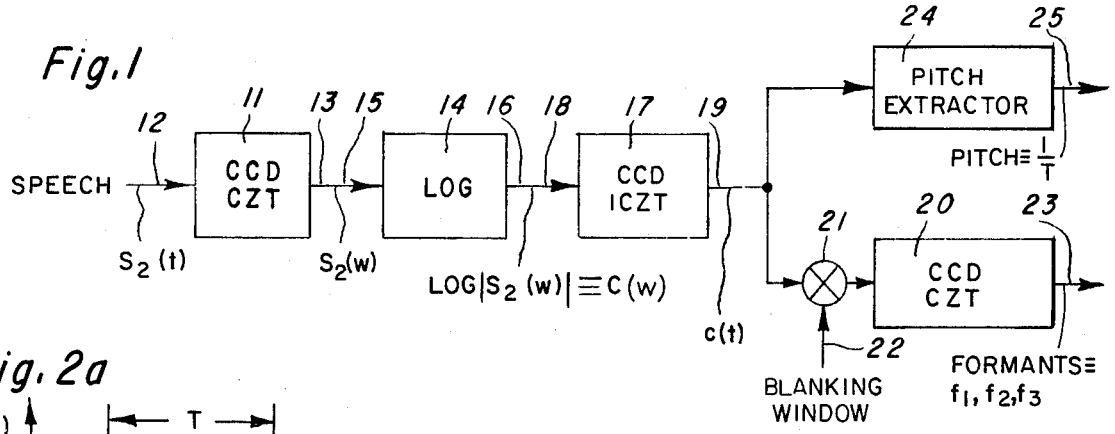
FIG. 1 is a functional block diagram of one embodiment of the invention for extracting formant and/or pitch data from a sampled speech input.
Figure 3:
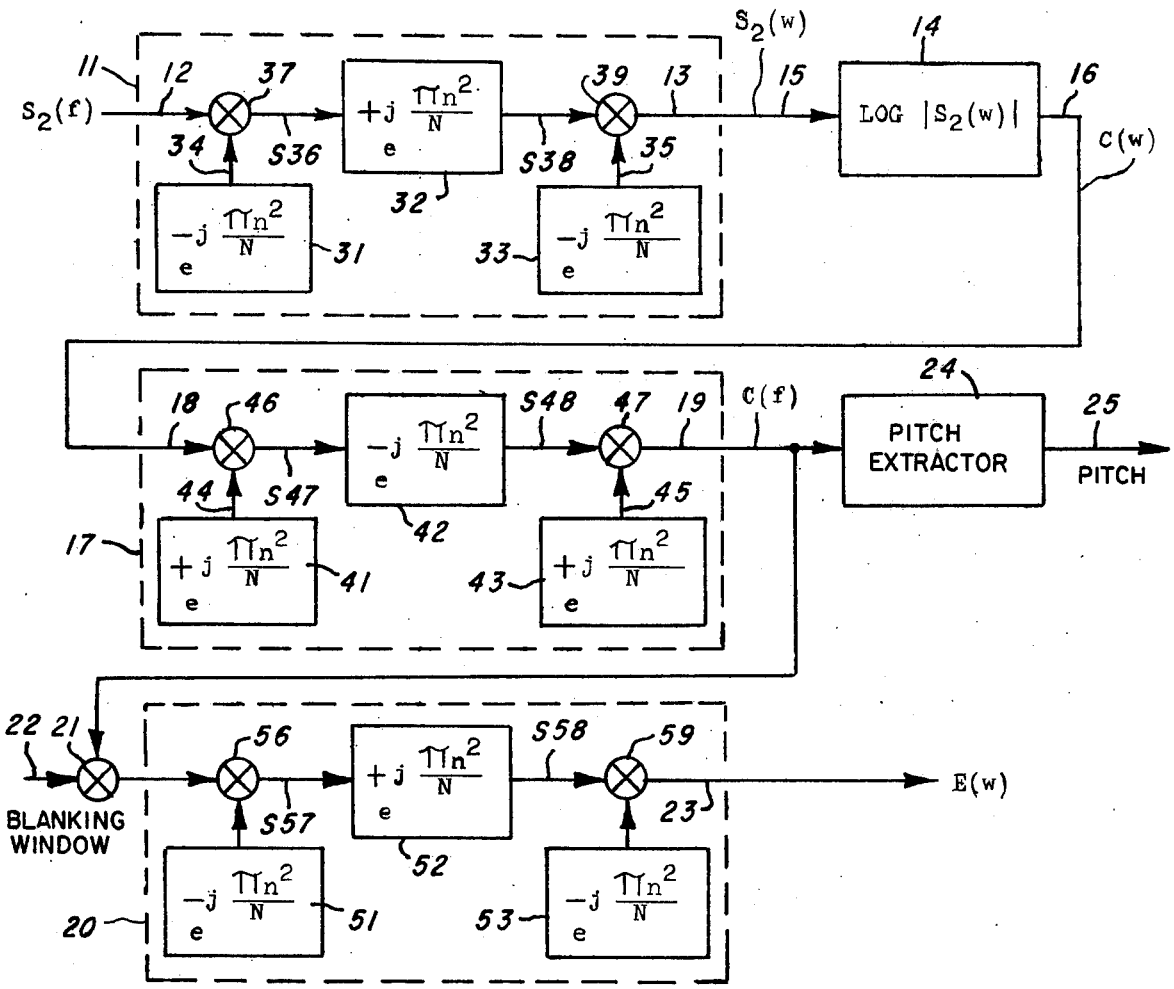
Figure 4:
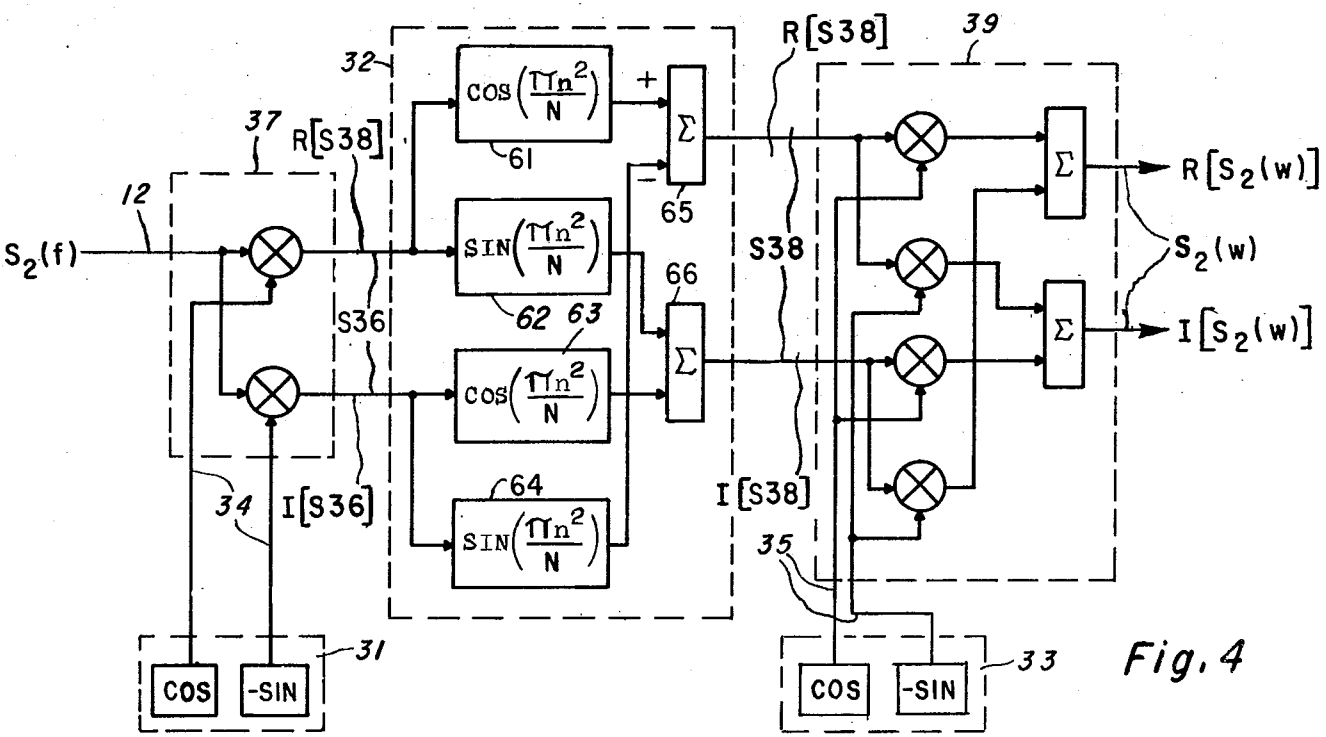
Figure 5:
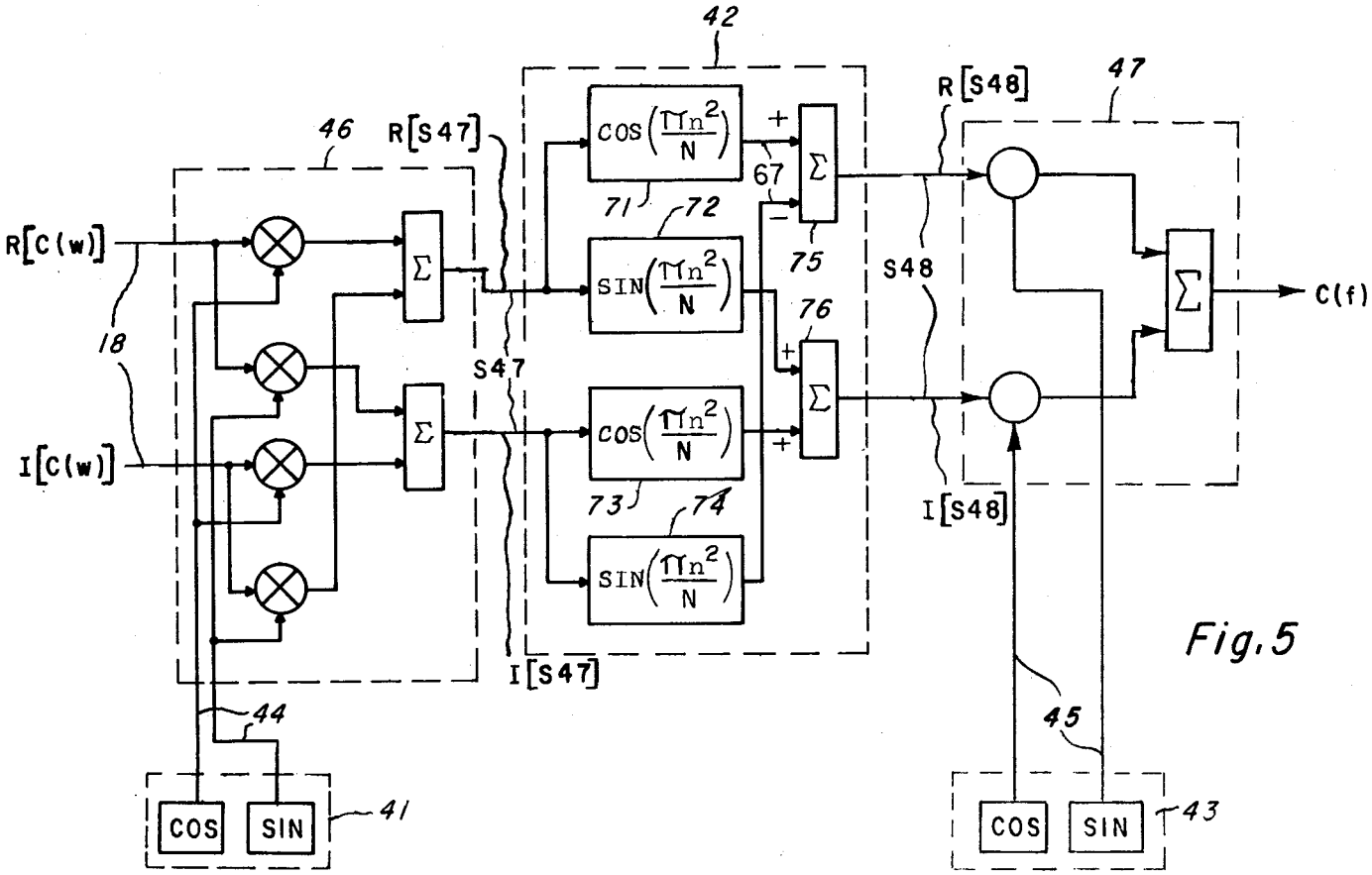
Figure 6:
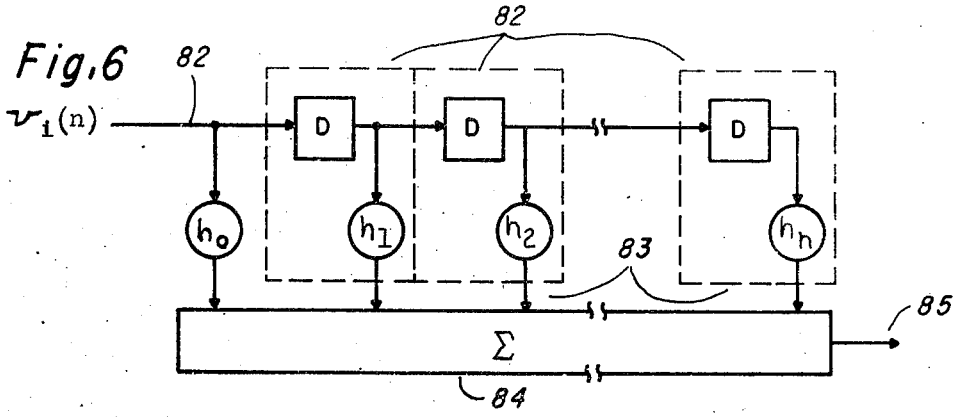
Figure 7A:
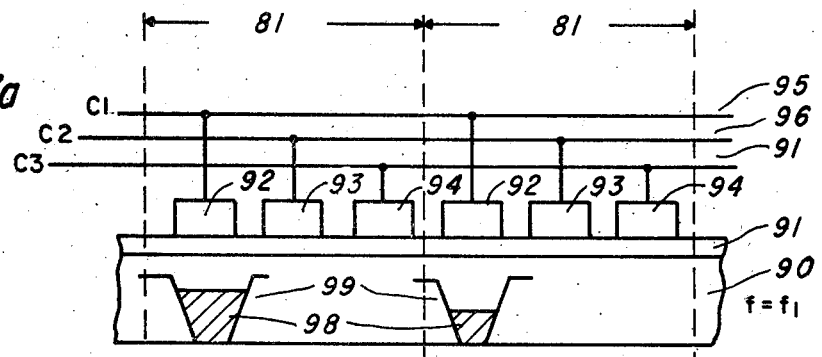
Figure 7B:
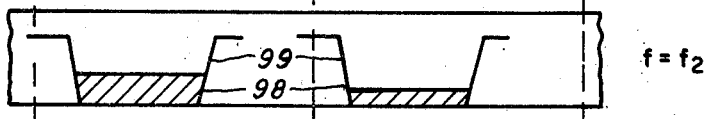
Figure 7C:
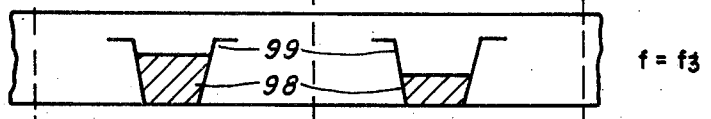
Figure 7D:
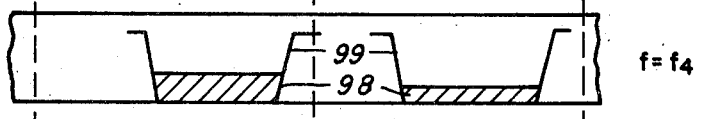
Figure 7E:
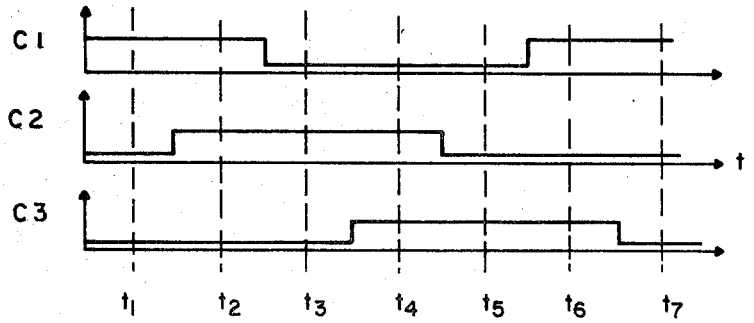

FIGS. *2a–2f* depict waveforms explanatory of the operation of FIG. 1; in particular FIG. *2e* showing the speech pattern, log power spectrum and cepstrum of an AHH sound, while FIG. *2f* shows respective parts of FIG. *2e* on an expanded time scale;

FIG. 3 shows in greater detail a particular implementation of FIG. 1;

FIGS. 4 and 5 show functional circuit diagrams of components of FIG. 1;

FIG. 6 illustrates, diagrammatically, a CCD transversal filter suitable for use in implementing Discrete Fourier Transform (DFT) and Inverse DFT functions in FIGS. 4 and 6;

FIG. *7a–7d* illustrate charge propagation between stages of a CCD filter as shown in FIG. 6 under control of waveforms as shown in FIG. *7e;*

Figure 8:
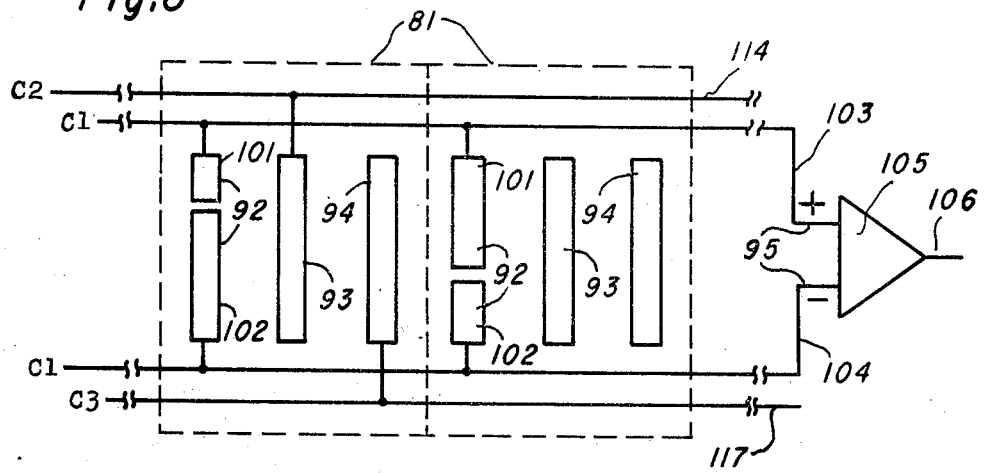
Figure 9:
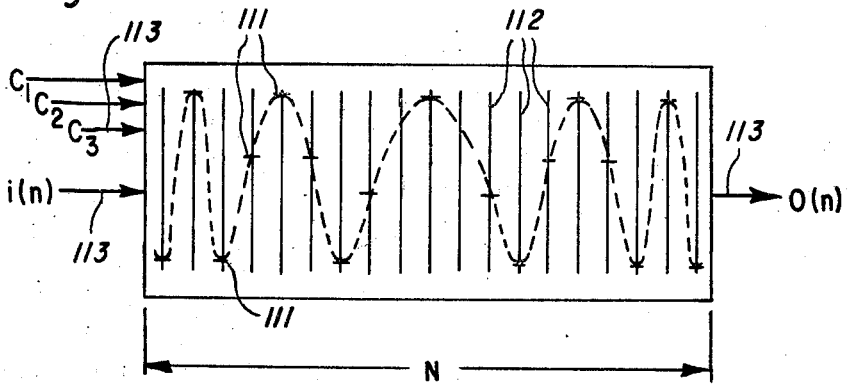
Figure 10:
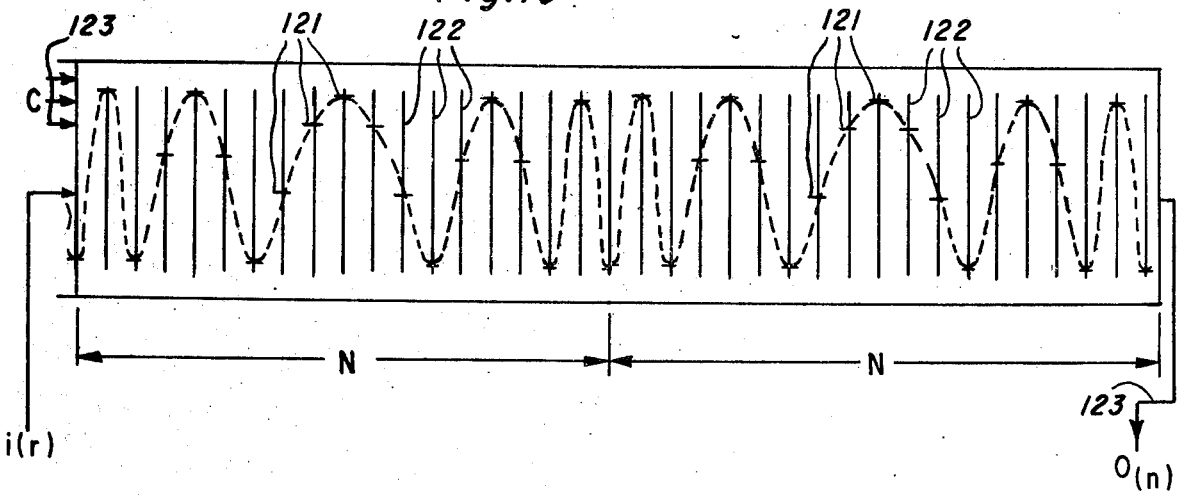
Figure 11:
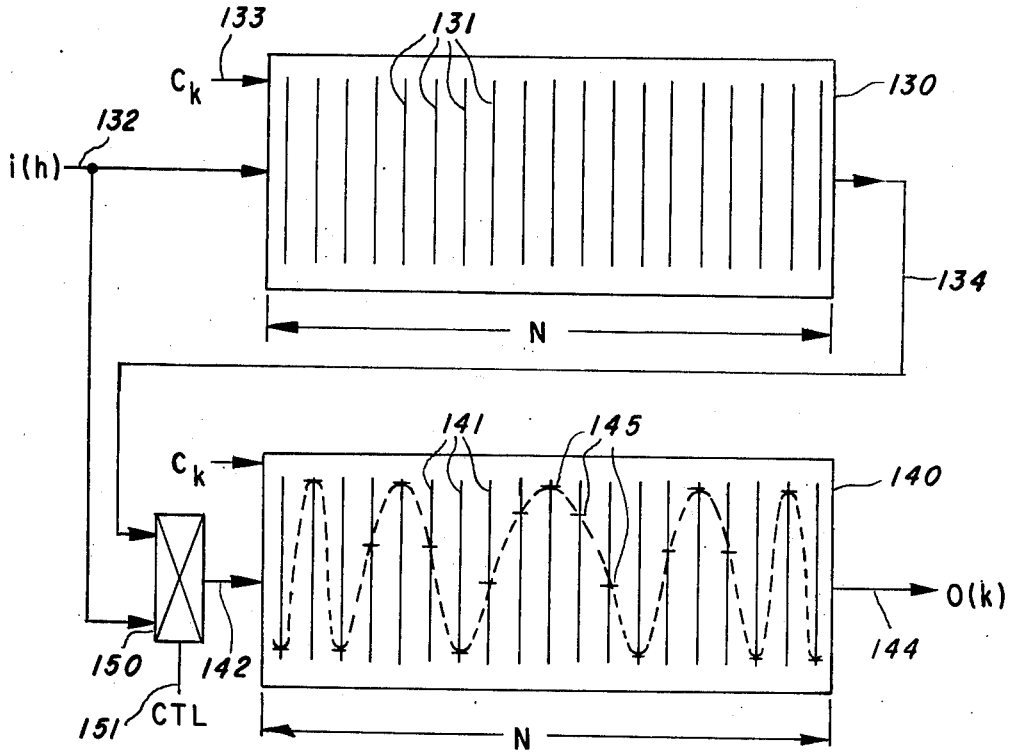
Figure 12:
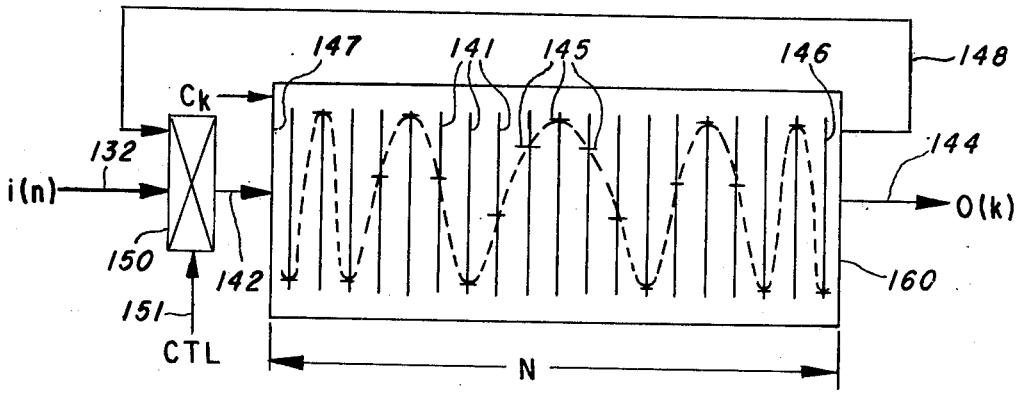
Figure 13:
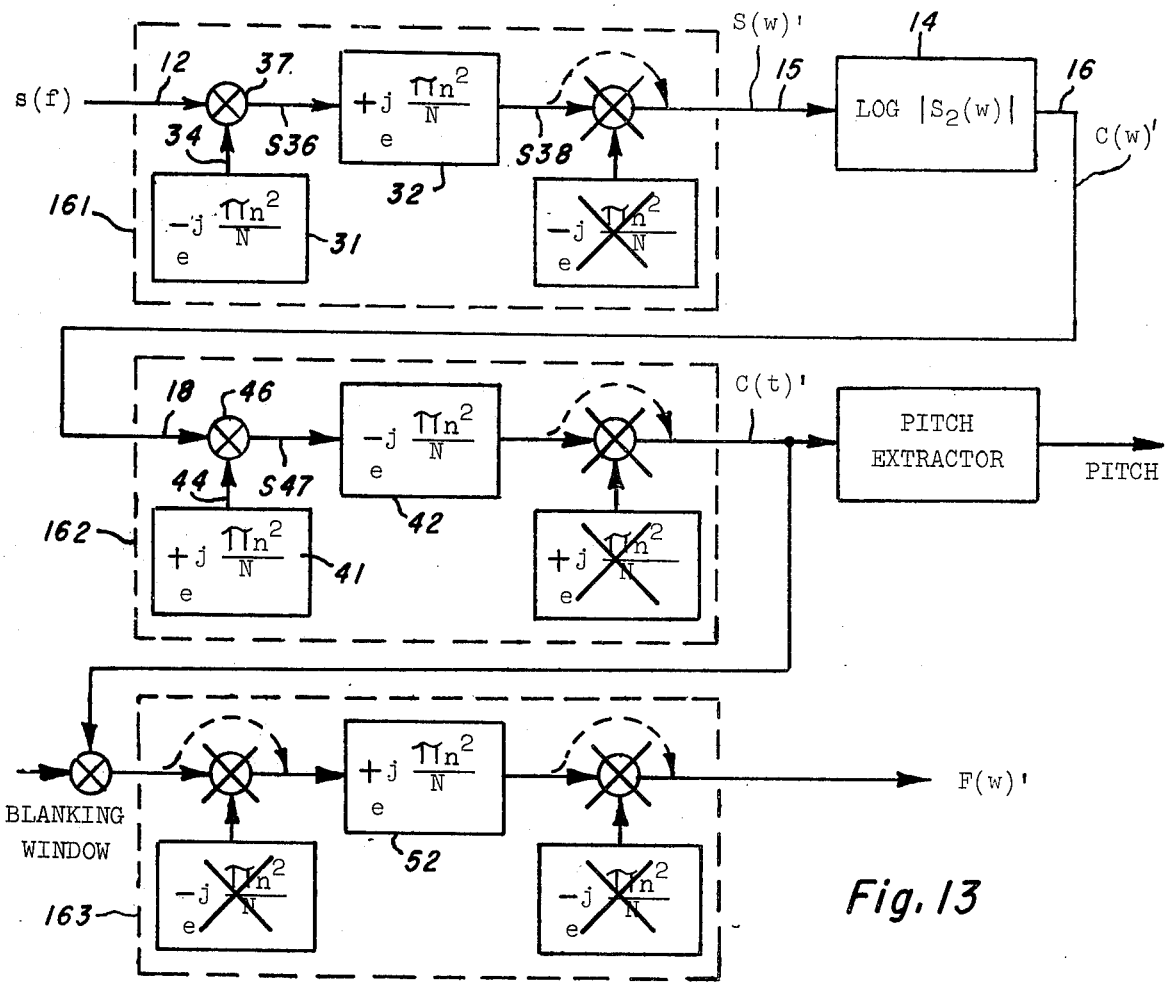
Figure 14:
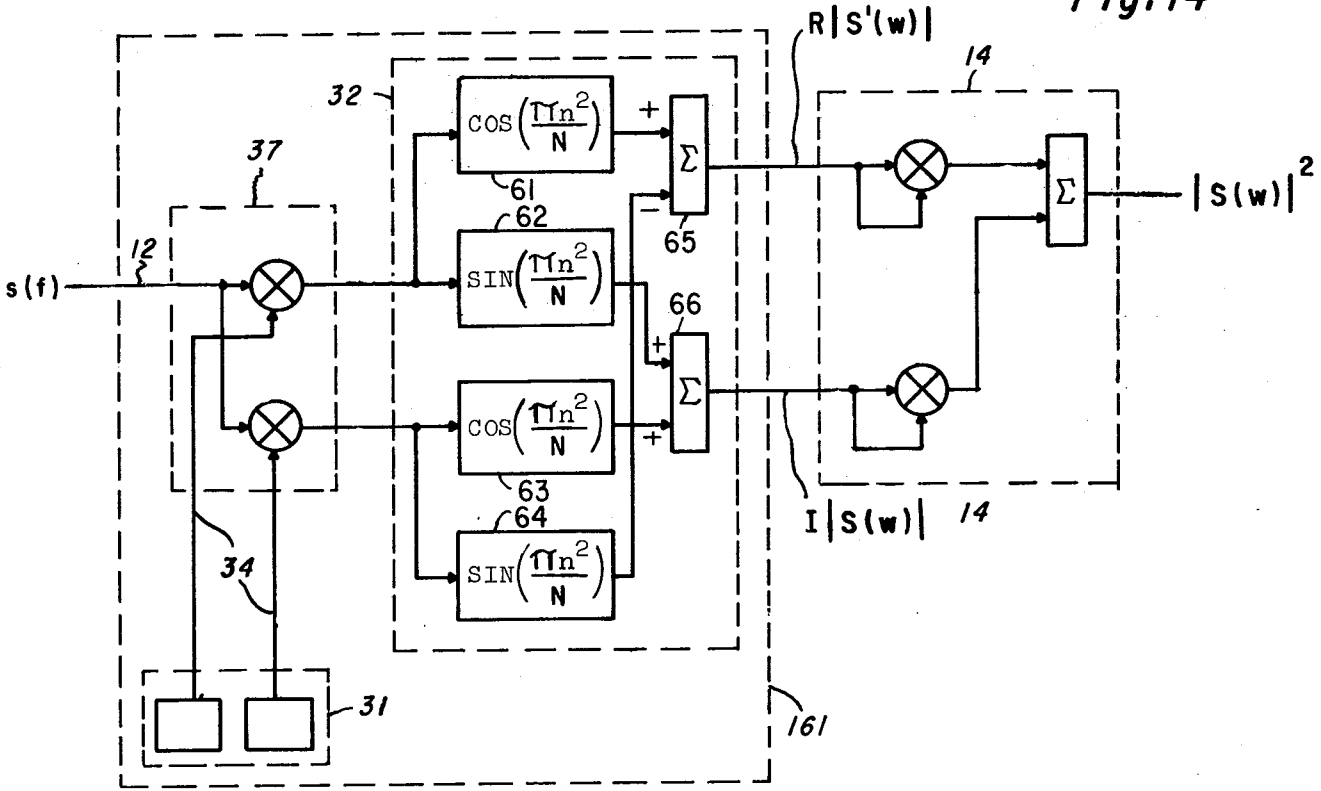
Figure 15:
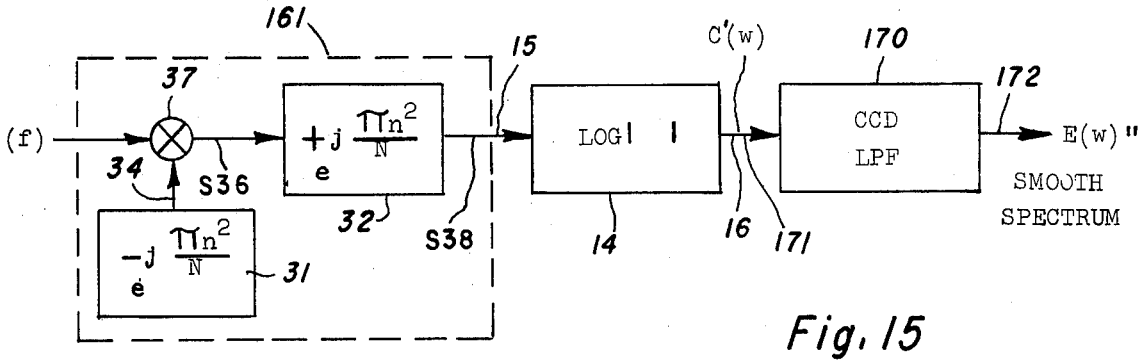
Figure 16:
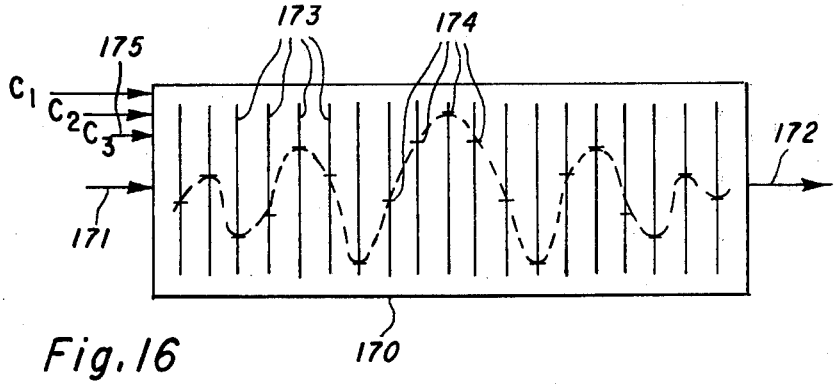
Figure 17:
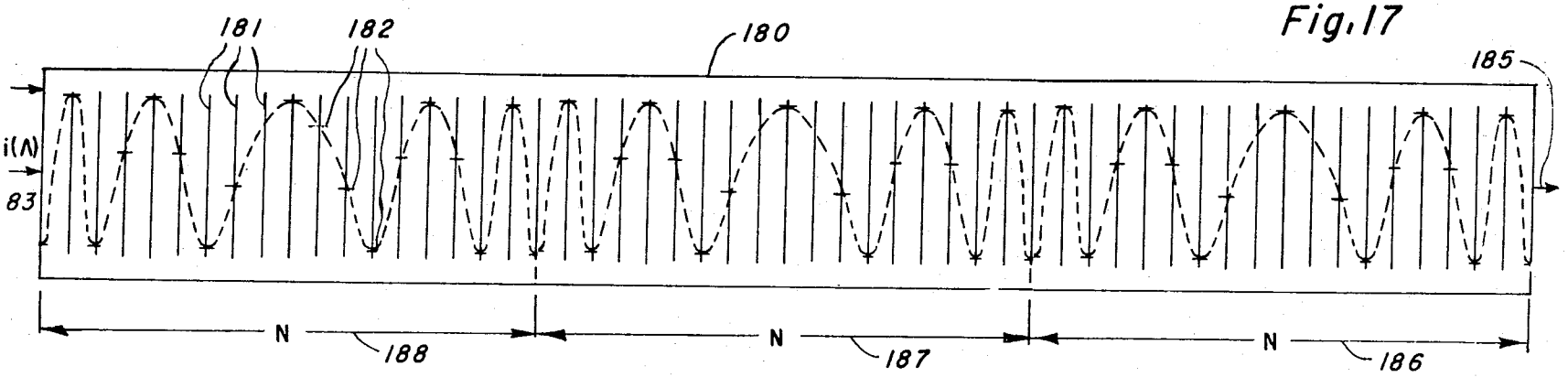
Figure 19:
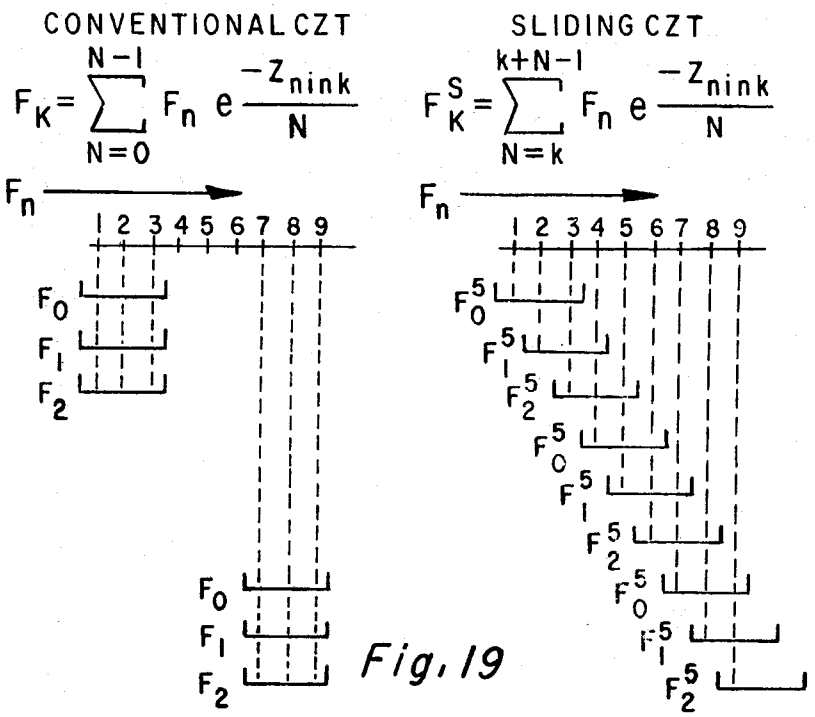
Figure 18:
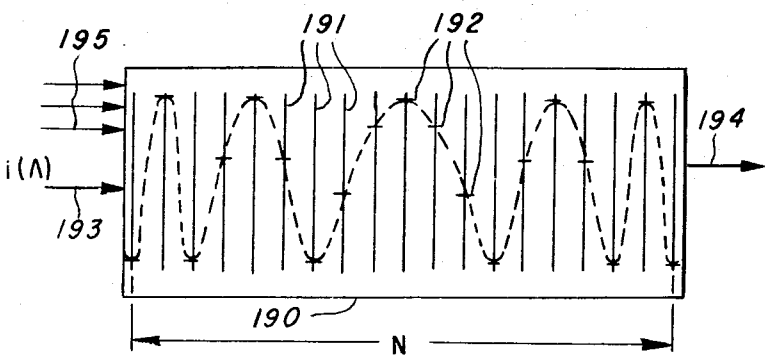

FIG. 8 illustrates split-electrode weighting in a CCD transversal filter as shown in FIG. 6;

FIG. 9 illustrates an N-stage CCD split-electrode configuration for implementing an impulse response $\cos\pi n^2/N$;

FIG. 10 illustrates a 2N-stage CCD split-electrode configuration for implementing an impulse response $\cos\pi n^2/N$;

FIGS. 11 and 12 illustrate alternative CCD structures for implementing DFT and IDFT functions in FIGS. 4 and 5, FIG. 11 including a CCD delay line and a CCD transversal filter while FIG. 12 includes a single CCD transversal filter;

FIG. 13 illustrates a modification of FIG. 3 using fewer components;

FIG. 14 is a functional circuit diagram of part of FIG. 13;

FIG. 15 illustrates another embodiment of the invention suitable for extracting formants data from a sampled speech input and using a CCD low pass filter;

FIG. 16 illustrates a CCD split-electrode configuration suitable for implementing a low pass response for the CCD filter of FIG. 15;

FIG. 17 illustrates a CCD split-electrode configuration suitable for producing an averaging operation on transforms of an input signal, used to implement DFT and IDFT functions in embodiments of the invention;

FIG. 18 illustrates a CCD split-electrode configuration suitable for implementing sliding DFT and sliding IDFT transforms in embodiments of the invention; and FIG. 19 provides a pictorial representation comparing a conventional CZT and sliding CZT for a 3-point transform.

DETAILED DESCRIPTION OF SPECIFIC EMBODIMENTS

Referring to FIG. 1, a block diagram of one embodiment of the invention - which is called a charge coupled device (CCD) speech processor - is illustrated. The speech processor is used to extract pitch and formant information from samples of speech signals. Pitch is the rate at which various basic air pressure patterns are repeated within the air pressure waveforms that are created whenever a word is spoken ("word" being used in a general sense to include all vocal sounds); and formants are the major frequency resonances of the vocal tract that comprise these basic air pressure patterns. Each basic pattern may have several formants and each word may be composed of several basic patterns.

The speech processor of FIG. 1 includes a CCD chirp Z transform (CZT) unit 11, a logarithmic response unit 14, a CCD chirp Z inverse transform unit 17, a second CCD chirp Z transform unit 20, and a pitch extractor unit 24. These units are interconnected as shown to implement an algorithm which is known as the homomorphic deconvolution of speech. This algorithm is described in Rabiner and Gold, *Theory and Application of Digital Signal Processing,* Prentice-Hall, 1975.The treatment there, however, is mathematical only; whereas here CCD's are used to implement major portions of the algorithm.

The functional operation of the CCD speech processor of FIG. 1 is illustrated by FIG. 2. In particular, FIG. 2*a* illustrates one of the basic air pressure patterns $s_1(t)$. This pattern combines with other patterns, not shown, to form words. For example, pattern $s_1(t)$ could represent the sound "ohh" in the word "hello". Typically, period T of the pattern is 10 ms, and it may be repeated hundreds of times within a single word.

Figure 2A:
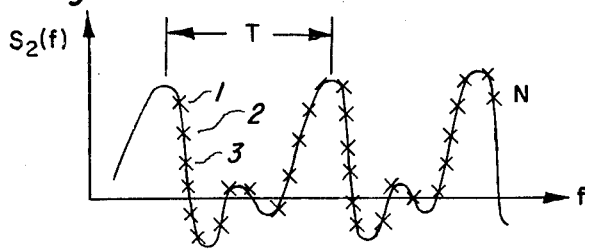
Figure 2B:
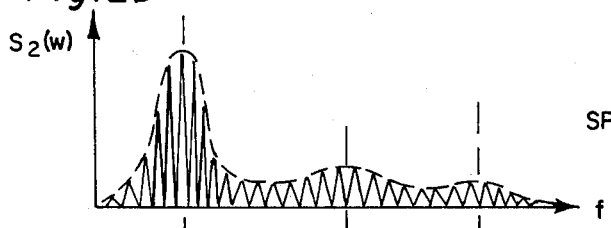

Transform unit 11 of FIG. 1 has an input lead 12 for receiving, e.g. from a transducer or speech record, time samples of electrical signals $s_2(t)$ that are proportional to the air pressure patterns $s_1(t)$. The function of unit 11 is to take N samples of signal $s_2(t)$ and to generate their corresponding frequency spectrum. N in this context is some integer which is large enough to cover the period T of the basic pattern at least once. The frequency spectrum is generated by unit 11 by performing a discrete Fourier transform on the N samples. Output leads 13 are provided on which are generated electrical signals $s_2(w)$ which represent the N components of the frequency spectrum of the N sample of $s_2(t)$. $S_2(w)$ is illustrated by FIG. 2*b*. Unit 11 performs the Fourier transform operation by utilizing CCDs to implement the chirp Z algorithm of the transform.

Figure 2C:
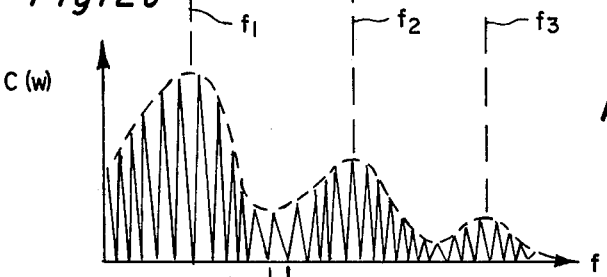

Logarithmic response unit 14 is coupled to receive signals $s_2(w)$ via input leads 15. This unit functions to perform a log operation on the magnitude of signals $s_2(w)$ producing a log-magnitude of the short term speech spectrum. Logarithmic response is not essential and other non-linear responses, e.g. hyperbolic sine, may be substituted. This operation accentuates the peak frequencies $f_1, f_2 \ldots$ (the formants) which occur within the $s_2(w)$ signals. In addition, the pitch information (1/T) in signal $s_2(w)$ is retained because log operation doesn't affect the spacing between the frequency components of the signal. Thus the output signal of unit 14 contain both pitch and formant information. This pitch-formant signal C(*w*) is generated on leads 16 as is illustrated by FIG. 2*c*.

The remaining signal processing apparatus of FIG. 1 operates on the pitch-formant signal C(*w*) in a manner designed to extract the pitch and the formant information. Unit 17 receives signals C(*w*) on input leads 18 and performs an inverse Fourier transform on the signal. This operation is performed using CCDs which implement the inverse chirp Z transform algorithm. As a result of this inverse transform, ceptrum signals $c(t)$ are generated on leads 19.

Figure 2D:
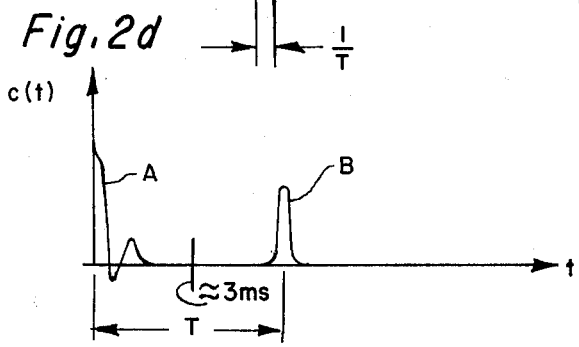
Figure 2D:
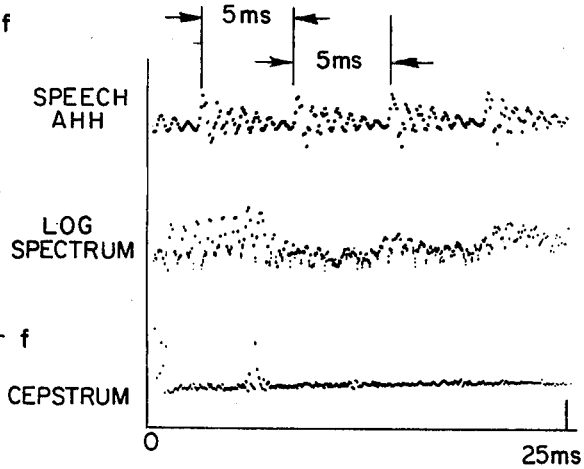
Figure 2D:
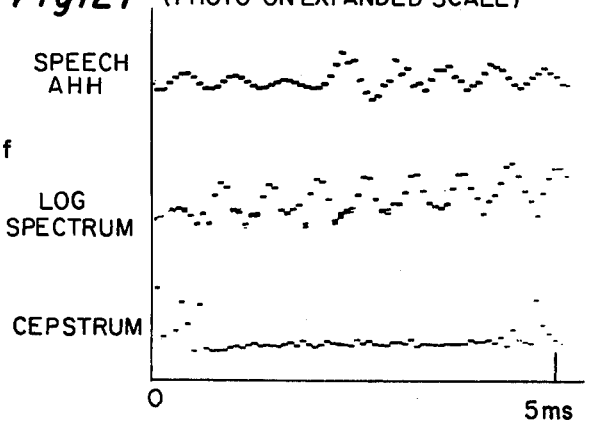

A typical ceptrum signal is illustrated by FIG. 2*d* and includes representations of the formants (vocal tract data) and pitch data in two distinct parts of that signal. The first part occurs in a time interval which lasts from approximately 0 to 3 ms. This portion of the ceptrum is labeled "A" in FIG. 2*d*. The shape of curve A reflects the locations of the formants of FIG. 2*c*. In comparison, the second part of the ceptrum occurs in the time interval of approximately 3 ms to 100 ms. This part of the ceptrum is labeled "B" in FIG. 2*d*. Curve B contains one large peak; and the exact time instant at which this peak occurs represents the period T of signals $s_1(t)$.

Multiplier 21 and transform unit 20 are used to extract formant information from ceptrum signal $c(t)$. To this end, lead 19 couples to one input of multiplier 21. A second input lead 22 is provided on multiplier 21 for receiving blanking signals. These blanking signals permit only the first portion of ceptrum signals $c(t)$ to pass into transform unit 20. That is, the signals blank out the second portion of signal $c(t)$. Typically, only 3 ms of the ceptrum signal is passed. But the actual length of the ceptrum which is passed may be varied to meet the particular characteristics of the speech input.

Unit 20 operates to perform a Fourier transform on the input signals which it receives. Output leads 23 are provided on which the Fourier transformed signals are generated. The transform operation is implemented with CCDs that are interconnected to perform an inverse discrete Fourier transform via the chirp Z transform algorithm. Thus, unit 20 has a construction which is identical to the construction of unit 11.

Pitch information is extracted from ceptrum signals $c(t)$ by unit 24. Conventional non-CCD circuitry may be used to perform the pitch extraction. For example, block 24 may include a blanking circuit (similar to multiplier 21) and a threshold level detector. The blanking circuit passes only the second half of the ceptrum signals, and the threshold circuit detects the time at which the pitch impulse in the second half of the ceptrum occurs. Output leads 25 are provided on which signals are generated to indicate the detected pitch impulse.

Referring now to FIG. 3, a functional circuit diagram of the CCD speech processor of FIG. 1 is illustrated. Discrete Fourier transform unit 11 is comprised of three basic components - a pre-chirp signal generator 31, a discrete Fourier transform (DFT) filter 32, and a post-chirp signal generator 33. Chirp generator 31 generates N electrical signals on leads 34 which are equal to $\mathrm{EXP}[-j\pi n^2/N]$. This function may be physical, constructed with CCDs or with read only memories (ROMs), or with read-write memories (RAMs). Similarly, chirp generator 33 has an identical functional requirement and an identical construction. It generates N signals on leads 35.

In comparison, DFT filter 32 has an impulse response of $\mathrm{EXP}[+j\pi n^2/N]$. Filter 32 receives signals S36 from the output of multiplier 37, and performs the mathematical operation $$\sum_{n=0}^{N-1} [S36(n)]\ [EXPj\pi(k-n)^2/N]$$

on these signals. In order to perform this operation, one embodiment utilizes CCD filters of length 2N however, 2N-1 stage filters could be used. The construction of these filters is covered in greater detail later in the description. The resulting signals S38 are received and operated on by multiplier 39 to generate signals $S_2(w)$.

Similarly, inverse discrete Fourier transform unit 17 is also comprised of three basic components - a prechirp signal generator 41, a discrete inverse Fourier transform (IDFT) filter 42, and a post-chirp signal generator 43. Chirp generators 41 and 43 generate N electrical signals on leads 44 and 45 respectively. These signals are defined as $EXP(+j\pi n^2/N)$. ROMs, RAMs, or CCDs may be used to physically construct these generators. A multiplier 46 produces signals S47 which are the product of the signals on leads 18 and 44. IDFT filter 42 receives signals S47 and performs the mathematical operation $$\sum_{n=0}^{n-1} [S47(n)]\ [EXP-j\pi(k-n^2/N]$$

on the signals. CCD registers of 2N stages are used to construct filter 42. The output signals, from filter 42 are received by multiplier 47. There they are combined with signals from chirp generator 43 to produce ceptrum signals $c(t)$ on lead 19.

The second DFT transform unit 20 also has three basic components - 51, 52, and 53. Components 51, 52, and 53 respectively perform in the same manner as chirp generator 31, DFT filter 32, and chirp generator 33. Thus, the construction of the respective components is identical.

FIG. 4 is a functional circuit diagram of DFT transform unit 11; and FIG. 5 is a functional circuit diagram of IDFT transform unit 14. Both of these circuits operate separately on the real and imaginary components of the complex signals which were previously indicated to exist in FIG. 3. This kind of separate operation is possible by application of the well-known identities $EXP(+j\theta)\equiv\cos\theta+j\sin\theta$, and $EXP(-j\theta)\equiv\cos\theta-j\sin\theta$. By application of the first identity, the impulse response of DFT filter 32 can be rewritten as $\cos[\pi n^2/N] + j\sin[\pi n^2/N]$. Thus, DFT filter 32 is comprised of transversal filters having impulse responses of $\cos[\pi n^2/N]$ and $\sin[\pi n^2/N]$. Two pairs of such transversal filters are required - one pair operates on the real part of signals S36, and the other operates on the imaginary part of signals S36. Also, as previously pointed out, each of these transversal filters is of length 2N. These filters are indicated at 61, 62, 63, 64 in FIG. 4. A pair of summers 65 and 66 are also provided to combine the real and imaginary components respectively of the output signals of filters 61–64.

Similarly, the impulse response of IDFT filter 42 can be rewritten as $\cos(\pi n^2/N) - j\sin(\pi n^2/N)$. Thus, as illustrated in FIG. 5, IDFT filter 42 is comprised of transversal filters having impulse responses of $\cos(\pi n^2/N)$ and $-\sin(\pi n^2/N)$. Again, two pairs of such transversal filters are required to permit separate operation on the real and imaginary components of the complex input signals $C(w)$. These filters are indicated as 71, 72, 73, and 74 in FIG. 5. Summers 75 and 76 respectively combine the real and imaginary components of output signals from these filters.

Referring to FIG. 6, a functional diagram of a CCD, arranged as a transversal filter is illustrated. The CCD is comprised, basically, of a serial array of several analog voltage delay stages 81. The first stage receives an input signal $v_i(n)$ on lead 82. Each stage feeds the next stage in series, and each stage also has a weighted output lead 83. Leads 83 connect to a summer 84. The output of summer 84 is a signal $v_o(n)$ on a lead 85. Additional means for injecting charge into the first stage and extracting charge from the last stage also exists but is not shown.

The impulse response $h(n)$ of the CCD in FIG. 6 is easily obtained by applying an impulse to the input, and by calculating the resulting output signal $v_o(n)$. If $v_i(0)=1$ and $v_i(n)=0$ for $n\neq 0$, then it is apparent that $v_o(n)$ equals $h_0, h_1, h_2, \ldots$ for $n=0, 1, 2 \ldots N-1$.

The above relation shows how to physically implement transversal filters 61–64, and 71–74. The impulse response of filter 61, for example, is $\cos(\pi n^2/N)$. This is implemented using the circuit of FIG. 6 and by setting $h_n=\cos(\pi n^2/N)$ for $n=0, \ldots 2N-1$. Similarly, filter 62 has an impulse response of $\sin(\pi n^2/N)$. It therefore is implemented using the circuit of FIG. 6 and by setting $h_n=\sin(\pi n^2/N)$ for $n=0, \ldots 2N-1$.

The majority of the apparatus of FIG. 1 can therefore be implemented using a total of twelve CCDs. This would include four transversal filters within DFT filter 32, four transversal filters within IDFT filter 42, and four transversal filters within DFT filter 52. The remaining circuitry of FIG. 1 can be built by conventional methods. For example, IGFET technology is compatible with CCD technology and may be used.

A more detailed description of one type of CCD (known as a 3-phase n-channel CCD) is illustrated in FIGS. *7a* to *7e*. FIG. *7a*, for example, illustrates a cross-sectional view of two adjacent analog delay stages within this type CCD. Basically, the stages 81 share a common semiconductor substrate 90 and a common insulating material 91 on which, for each stage, a set of three electrodes 92, 93, 94 is disposed, with three common clock leads 95, 96, 97 which interconnect the three electrodes of each stage.

Signal $v_i(k)$ of each stage 81 is carried by packets of minority charge carriers 98 within substrate 90. These packets 98 are trapped by potential wells 99 within each stage. Potential wells 99 are formed under electrodes 92, 93, or 94 by applying a voltage of proper polarity to leads 95, 96, or 97 respectively. The proper polarity is one which will attract the minority charge carriers. For example, if substrate 90 is p-type silicon, the minority charge carriers are electrons, and thus a potential well is formed by applying a positive voltage to leads 95, 96 or 97.

Charge packets 99 are moved from stage to stage by properly sequencing the voltage on leads 95, 96 and 97. FIGS. *7a–7e* illustrate this charge transfer mechanism. At a time $t_1$ clock C1 on lead 95 is at a high voltage while clock C2 on lead 96 and clock C3 on lead 97 are near ground. Thus, a potential well is only formed under electrodes 92 of each stage as illustrated in FIG. *7a*. At a time $t_2$, clocks C1 and C2 both are at a high voltage while clock C3 remains at ground. Thus a potential well is formed under electrodes 92 and 93; and the charge packets 99 are distributed under these electrodes as illustrated in FIG. *7b*. At a time $t_3$, clock C2 has a high voltage while clocks C1 and C3 are at ground. Thus a potential well is formed only under electrodes 93; and thus charge packets 99 exist only under electrodes 93. This sequence can be continued, as indicated by time instants $t_1 - t_7$, until the charge packet under electrode 92 of one stage 81 has moved under electrode 92 of the adjacent stage. The time interval in which sequence $t_1 - t_7$ occurs is the time delay $T_s$ of each stage.

Referring to FIG. 8, one implementation of weighted output leads 83 and summer 84 is illustrated. This implementation is called a split electrode CCD. In the split electrode CCD, one electrode of each stage 81 is split into two partial electrodes. FIG. 8 illustrates a top view of a CCD in which electrode 92 is split into leads 103 and 104.

The principle of operation of the split electrode CCD is that as charge packets 98 transfer within substrate 90 under an electrode, a proportional but opposite charge must flow into the electrode from the clock line. Since the charge packets 98 are nearly evenly distributed under electrodes 92, the amount of charge which flows into each electrode portion 101 and 102 is proportional to its area.

Positive and negative weights are obtained by letting the charge in partial electrode 101 represent a positive value, by letting the charge in partial electrode 102 represent a negative value, and by substracting the two values by a subtractor 105. For example, to obtain a value of $h_m = +1$, the split in the $m^{th}$ stage should occur so all the charge flows into partial electrode 101. To obtain a value of $h_m = -1$, the split in the $m^{th}$ stage should occur so all the charge flows into partial electrode 102. And to obtain a value of $h_m = 0$, the split in the $m^{th}$ stage should occur so an equal amount of charge flows into partial electrodes 101 and 102. Values of $h_m$ between $+1$ and $-1$ are limited only by the accuracy of placement of the split.

FIG. 9 illustrates a top view of a split electrode CCD transversal filter of length N in which splits 111 on electrodes 112 are arranged to obtain an impulse response of $\cos(\pi n^2/N)$. Such an electrode arrangement could be used to implement the chirp signal generators for example. Similarly, FIG. 10 illustrates the top view of a split electrode CCD transversal filter of length 2N in which the splits 121 on electrodes 122 are also arranged to obtain impulse response of $\cos(\pi n^2/N)$. This type of CCD electrode arrangement is used to implement filters 61, 63, 71, 73 and also parts of DFT filter 52. Filters 62, 64, 72, 74 and parts of DFT filter 52 are similarly constructed with split electrode CCD transversal filters of length 2N, the only difference being that these filters have their splits arranged to yield an impulse response of $\sin(\pi n^2/N)$.

Using present integrated circuit technology, split electrode transversal filters having approximately 500 stages may readily be constructed on a single semi-conductor chip. Alternatively, several split electrode filters each having fewer stages may be constructed on a single chip. Typically, these chips are approximately 200 mils on a side. Leads 113 and 123 are provided to receive clocking signals, as well as to receive input signals and transmit output signals.

Referring next to FIG. 11, a second embodiment of the transversal filters which comprise DFT filters 32, 52 and IDFT filter 42 is illustrated. This embodiment has two major components - an N stage CCD delay line 130, and an N stage CCD transversal filter 140. That is, each stage of delay line 130 has only whole electrodes 131, whereas each stage of filter 140 has one split electrode 141. The splits 145 in electrodes 141 in FIG. 11 are arranged to yield an impulse response to the form $\cos(\pi n^2/N)$. Clearly, the splits could also be arranged in a $\sin(\pi n^2/N)$ configuration and thereby implement the other required transversal filters.

The electrical operation of the circuit of FIG. 11 is as follows. During one time interval, N samples of input signal $i(n)$ are received on lead 132 by delay line 130 and are also received by lead 142 by filter 140. A control signal CTL is applied to a lead 151 of a $2 \times 1$ switch 150 which causes signal $i(n)$ to be passed as the sole input to lead 142. Clocking signals are applied to inputs 133 and 143; and these signals cause charge packets representing the N samples of input signal $i(s)$ to be propagated through the N stages of delay line 130 and filter 140.

During a second time interval, a control signal CTL is applied to switch 150 via lead 151. This signal causes output signals on lead 134 to be passed as the sole input onto lead 142. Thus during this second time interval, filter 140 receives the exact same set of inputs which it received during the first time interval. Also during this time interval the $k^{th}$ output signal $o(k)$ on lead 144 is represented by the expression $$\sum_{n=0}^{N+1} i(n)\cos\pi(n-k)^2/N.$$

This is the real component of the impulse response which is required for DFT filters 32 and 52, and IDFT filter 42.

FIG. 12 illustrates a third embodiment of the transversal filters which comprise DFT filters 32, 52 and IDFT filter 42. This embodiment is comprised of only one N-stage CCD transversal filter 160. With one exception, filter 160 is constructed exactly like filter 140. That exception includes means for feeding back charge from the last stage 146 of filter 160 into the first stage 147 via lead 148.

In operation, the first consecutive N input samples of signal $i(n)$ are received via leads 132 and 142; whereas the next N input samples are received via lead 148 from the last stage 146 and lead 142. Filter 160 thus produces the exact same output signals $o(k)$ as were produced by the filter of FIG. 11. This is because the signals being operated on by the two circuits are exactly the same. The only difference in the circuits is that filter 160 performs both a filter and a delay line function. Thus a separate N stage delay line is not needed.

Referring next to FIG. 13, a functional circuit diagram of another embodiment of a CCD speech processor embodying the invention is illustrated. This speech processor is a simplified version of the speech processor that is illustrated by FIGS. 3, 4 and 5.

There are three major components to the speech processor of FIG. 13 - a modified DFT chirp Z transform unit 161, a modified IDFT chirp Z transform unit 162, and a second modified DFT chirp Z transform unit 163. Transform unit 161 is constructed similarly to the previously described transform unit 11. The only difference between the two transform units is that the former has no post chirp signal generator 33 and no associated multiplier 39. Elements 33 and 39 are eliminated because they contribute only a phase factor to signal S38. That is, they do not affect the magnitude of that signal. And the logarithmic response unit 14 which receives signal S38 operates only the magnitude of that signal.

FIG. 14 is a functional circuit diagram of modified DFT transform unit 161. Comparing this figure to FIG. 11 illustrates the substantial savings in circuitry which are achieved by modified transform unit 161 over the previously described transform unit 12.

Inverse transform unit 162 is constructed similarly to the previously described inverse transform unit 17. The only difference between the two inverse transform units is that post chirp generator 43 and multiplier 47 are eliminated in inverse transform unit 162. The elimination of these elements is possible because of two factors which depend upon whether formant or pitch information is being extracted from the processed signals. If formant information is being extracted, then the multiplications performed by multiplier 47 and chirp generator 43 cancel the multiplications performed by multiplier 37 and chirp generator 51 of the second DFT transform unit. Thus, circuit elements 43 and 47 are not required to extract formant information. Similarly, if pitch information is being extracted, then the multiplication performed by elements 43 and 47 can be eliminated because the pitch detector is basically a magnitude detecting circuit, and multiplication by the chirp signals only affects the phase of the product signal. Accordingly, inverse transform unit 162 is constructed exactly like inverse transform unit 17 with the exception that post chirp generator 43 and multiplier 47 are eliminated.

The second modified DFT transform unit consists only of a single DFT filter 52. That is, both pre-chirp and post-chirp multipliers are eliminated. The reason why the pre-chirp multiplication is eliminated has already been alluded to - namely, pre-multiplication in the second DFT transform unit cancels the post-multiplication in the IDFT unit. Therefore, both of these operations are unnecessary. Similarly, post-chirp generator 53 and multiplier 59 are eliminated because they contribute only phase information to signals S58, whereas the desired formant information lies in the magnitude of signals S58.

Still another embodiment of the CCD speech processor is illustrated in functional circuit diagram form by FIG. 15. This embodiment extracts formant information only, but does so at a substantial savings in circuitry. This speech processor has three major components - a modified DFT chirp Z transform unit 161, a logarithmic response unit 14, and a low-pass filter 170. Units 161 and 14 are interconnected and constructed as previously described. The low-pass filter 170 has leads 171 which are connected to receive the output signals of unit 14. Leads 172 are provided on which are generated signals E $(w)''$ representing the filtered input signals.

The reasons why a low-pass filter operates to extract formant information from the speech input signals $s_2(t)$ may be understood by referring to FIG. 2. In particular, FIG. 2c illustrates the output signals of logarithmic response unit 14. There, the signals are represented as a function of frequency. However, these signals are generated one at a time by the signal processor; and thus they are also a function of time. The signal processor first generates the lowest frequency component, then it generates an adjacent frequency component, etc. Thus by replacing "f" with "t" on the horizontal axis of FIG. 2b, one obtains the time representation of how the signal processor actually computes each of the frequency components. The envelope E $(w)''$ of these time signals is a slowly varying signal, and thus it is obtained by low pass filtering of the $C'(w)$ signal.

Filter 170 is constructed with one CCD transversal filter, a top view of which is illustrated in FIG. 16. The electrodes 173 of filter 170 have splits 174 which are arranged in the form of $(w_k)$ $(\sin x/x)$. In this expression, $w_k$ is a window function which may be of an elevated cosine form. Other window functions are, of course, also acceptable. The primary requirement is that filter 170 has a low pass response and has an impulse response which is a function of $\sin x/x$. Clocking leads 175 are also provided for controlling the propagation of the input signals through the filter.

Referring to FIG. 17, a top view is illustrated of another embodiment of the transversal filter which comprise DFT and IDFT filters 32, 42, and 52. This embodiment is used to generate "$n$" transforms each of length N, on the filter input signals and to sum or average the result. For example, utilizing this embodiment, a 500 stage filter can be constructed to generate 5 transforms of 100 words each, and to average the result.

Filter 180, as illustrated in FIG. 17 generates and averages 3 of the previously described $\cos n^2/N$ transforms. Each transform is of length N. To accomplish this, the electrodes 181 of filter 180 are arranged so that the splits 182 repeat the $\cos(n^2/N)$ pattern three times. The $k^{th}$ spectral component is computed from 3N data samples. Samples $x$ through $x_{N+k-1}$ lie under the first N electrodes 85; samples $x_{N+k}$ through $x_{2N+k-1}$ lie under the second N electrodes 187; and samples $x_{2N+k}$ through $x_{2N+k-1}$ lie under the third set of N electrodes 188. Similarly the $k+1$ spectral component is completed by shifting the previous 3N samples one stage and by inputting one new sample. The input chirp generator behaves exactly as if an N-point transform were being performed on each of the N samples except that the input data sampling is continuous. That is, no blanking periods are required as they were during the operation of 2N stage circuit of FIG. 10. The filter of FIG. 17 can be modified for larger "N" values by adding more stages; and also can be modified to have a different impulse response by changeing the split electrode pattern.

Referring now to FIG. 18 still another embodiment of the transversal filters which comprise DFT filters 32 and 52, and IDFT filters 52 is illustrated. This embodiment generates a sliding DFT and a sliding IDFT transform. Each spectral component of the sliding discrete transform is defined by the equation $$F_k^s = \sum_{n=k}^{k+n} [f_n]\,[EXP - j\pi nk/N].$$

Thus the sliding transform differs from the conventional transform in that the sliding transform indexes the data sample which are operated on each time a spectral component $F_K^s$ is calculated.

FIG. 19 gives a pictorial comparison between the conventional CZT and the sliding CZT for the simple case of a 3-point transform. With the conventional CZT, all three Fourier co-efficients $F_0$, $F_1$, $F_2$ are calculated using the first three time samples $f_1$, $f_2$, $f_3$. These coefficients are being calculated by the filter during the next three clock periods, so that time samples $f_4 - f_6$ must be blanked. Then the cycle repeats as shown in FIG. 19. Using the sliding CZT, $F_0^s$ is calculated on the sample record $f_1$, $f_2$, $f_3$; $F_2^s$ on the record $f_3$, $f_4$, $f_5$; and $F_3^s$ is calculated on the sample record $f_4$, $f_5$, $f_6$. The sample record is continually updated by replacing the oldest sample with a new one.

One advantage of the sliding CZT filter 190, as illustrated in FIG. 18, is that for an N-point transform only N stages are required in the filters. Split electrodes 191 are provided with each stage, an the splits 192 have the profile of the desired impulse response. For example, the splits 192 of the filter of FIG. 18 have a $\cos(\pi n^2/N)$ configuration. Another advantage of the sliding CZT filter is that it operates without requiring a blanking period on the input signals. That is, input signals $i(n)$ on input lead 193 are continuously sampled; and the chirp generator which couples to lead 193 operates continuously. Thus the control of the input to the filter is simplified.

It will be appreciated that other than 3-phase CCD structures, in particular 2-phase or 4-phase, structures may be used in implementing the various CCD structures described herein.

What is claimed is:

1. Apparatus for performing the homomorphic deconvolution of speech comprising:

(a) First charge transfer device transform means having an input coupled to receive analog electrical signals representing speech for sampling said signals and performing thereon an analog discrete Fourier transform via the chirp Z transform algorithm to produce analog output signals $S_2(\omega)$ representing the components of said discrete Fourier transform.

(b) Circuit means coupled to receive said $S_2(\omega)$ signals from said first transform means for generating in response thereto analog output signals $C(\omega)$ comprising a non-linear function of the magnitude of said $S_2(\omega)$ signals;

(c) Second charge transfer device transform means coupled to receive said $C(\omega)$ signals from said circuit means for performing thereon an analog inverse discrete Fourier transform via the chirp Z transform algorithm to produce analog cepstrum signals $c(t)$.

2. Apparatus according to claim 1, wherein said first charge transfer device transform means comprises:

premultiplication means for premultiplying said speech samples by a factor EXP-$j$ $n^2/N$; first charge transfer device convolution means having a complex impulse response of EXP$j$ $n^2/N$ for convolving with said premultiplied speech samples; and post-multiplication means connected to the output of said first convolution means for multiplying said convolution output signals by a factor EXP-$j$ $n^2/N$ to produce said $S_2(\omega)$ signals;

and wherein said second charge transfer device transform means comprises:

premultiplication means for receiving said $C(\omega)$ signals for premultiplication by a factor EXP$j$ $n^2/N$; second charge transfer device convolution means having a complex impulse response of EXP$j$ $n^2/N$ for convolving with said premultiplied $C(\omega)$ signals; and post-multiplication means connected to the output of said second convolution means for multiplying said convolution output signals by a factor EXP$j$ $n^2/N$ to produce said cepstrum signals $c(t)$.

3. Apparatus according to claim 2 wherein said first and second convolution means are each comprised of four charge transfer device transversal filters.

4. Apparatus according to claim 3 wherein said four charge transfer device transversal filters include two charged transfer device transversal filters having impulse response of $\cos(\pi n^2/N)$ and two transfer device transversal filters having an impulse response of $\sin(\pi n^2/N)$.

5. Apparatus according to claim 4 wherein each of the said transversal filters has $M \times N$ stages which are grouped in M blocks of N stages, each of said blocks having an identical impulse response, for generating a convolution representing the average of said M impulse responses.

6. Apparatus according to claim 4 wherein said charge transfer device transversal filters each include an N stage charge transfer device and an analog $2 \times 1$ switch, said delay line having an input coupled to a first input on said $2 \times 1$ switch and having an output coupled to a second input on said $2 \times 1$ switch, said $2 \times 1$ switch having an output coupled to the input of said transversal filter.

7. Apparatus according to claim 4 wherein said transversal filters are comprised of N stage for computing a sliding discrete transform.

8. Apparatus according to claim 4 wherein each of said premultiplication means and said post-multiplication means are comprised of charge transfer device transversal filter means having an impulse response of said factors for generating analog electrical signals representing said factors.

9. Apparatus according to claim 3 further including third charge transfer device transform means having an input coupled to receive selected portions of said cepstrum signals $c(t)$ for performing thereon an analog discrete Fourier transform via the chirp Z transform algorithm to produce analog output signals containing formant information of said speech signals.

10. Apparatus according to claim 4 further including third charge transfer device transform means comprised of premultiplication means for premultiplying selected portions of said cepstrum signals by a factor EXP-$j$ $n^2/N$; third charge transfer device convolution means having a complex impulse response of EXP$j$ $n^2/N$ for convolving said premultiplied cepstrum portions; and post-multiplication means connected to the output of said third convolution means for multiplying said convolution output signals by a factor EXP-$j$ $n^2/N$.

11. Apparatus for performing the homomorphic deconvolution of speech comprising:

(a) First charge transfer device transform means having an input coupled to receive analog electrical signals representing speech for sampling said signals and performing thereon an analog modified discrete Fourier transform via a chirp Z transform algorithm but without post multiplication to produce analog output signals $S_2(\omega)$ representing the components of said modified discrete Fourier transform.

(b) Circuit means coupled to receive said $S_2(\omega)$ signals from said first transform means for generating in response thereto analog output signals $C(\omega)$ comprising a non-linear function of the magnitude of said $S_2(\omega)$ signals;

(c) Second charge transfer device transform means coupled to receive said $C(\omega)$ signals from said circuit means for performing thereon an analog modified inverse discrete Fourier transform via the chirp Z transform algorithm but without post multiplication to produce analog modified ceptrum signals $c(t)$.

12. Apparatus according to claim 11, wherein said first charge transfer device transform means comprises:

premultiplication means for premultiplying said speech samples by a factor EXP-$j\ n^2/N$; and first charge transfer device convolution means having a complex impulse response of EXP$j\ n^2/N$ for convolving said premultiplied speech samples to produce said $S_2(\omega)$ signals;

and wherein said second charge transfer device transform means comprises:

premultiplication means for receiving said $C(\omega)$ signals for premultiplication by a factor EXP$j\ n^2/N$; and second charge transfer device convolution means having a complex impulse response of EXP$j\ n^2/N$ for convolving said premultiplied $C(\omega)$ signals to produce said $c(t)$ signals.

13. Apparatus according to claim 12 wherein said first and second convolution means are each comprised of four charge transfer device transversal filters.

14. Apparatus according to claim 13 wherein said four charge transfer device transversal filters include two charged transfer device transversal filters having impulse resonse of $COS(\pi n^2/N)$ and two transfer device transversal filters having an impulse response of $SIN(\pi n^2/N)$.

15. Apparatus according to claim 14 wherein each of the said transversal filters has $M \times N$ stages which are grouped in M blocks of N stages, each of said blocks having an identical impulse response, for generating a convolution representing the average of said M impulse responses.

16. Apparatus according to claim 14 wherein said charge transfer device transversal filters each include an N stage charge transfer device and an analog $2 \times 1$ switch, said delay line having an input coupled to a first input on said $2 \times 1$ switch and having an output coupled to a second input on said $2 \times 1$ switch, said $2 \times 1$ switch having an output coupled to the input of said transversal filter.

17. Apparatus according to claim 14 wherein said transversal filters are comprised of N stage for computing a sliding discrete transform.

18. Apparatus according to claim 14 wherein each of said premultiplication means are comprised of charge transfer device transversal filter means having an impulse response of said factors for generating analog electrical signals representing said factors.

19. Apparatus according to claim 11 further including third charge transfer device transform means having an input coupled to receive selected portions of said $c(t)$ signals for performing thereon an analog modified discrete Fourier transform via the chirp Z transform algorithm but without premultiplication and without post-multiplication to produce analog output signals indicating the formants of said speech signals.

20. Apparatus according to claim 12 further including third charge transfer device transform means comprised of third charge transfer device convolution means having a complex impulse response of EXP$j\ n^2/N$ for convolving selected portions of said $c(t)$ signals.

21. Apparatus for performing the homomorphic deconvolution of speech comprising:

(a) charge transfer device transform means having an input coupled to receive analog electrical signals representing speech for sampling said signals and performing thereon an analog modified discrete Fourier transform via a chirp Z transform algorithm but without post-multiplication to produce analog output signals $S_2(\omega)$ representing the components of said modified discrete Fourier transform.

(b) circuit means coupled to receive said $S_2(\omega)$ signals from said first transform means for generating in response thereto analog output signals $C(\omega)$ comprising a non-linear function of the magnitude of said $S_2(\omega)$ signals;

(c) charge transfer device filter means coupled to receive said $C(\omega)$ signals from said circuit means for performing a low-pass filtering operation thereon to thereby extract formant information from said speech.

22. Apparatus according to claim 21, wherein said charge transfer device transform means comprises:

premultiplication means for premultiplying said speech samples by a factor EXP-$j\ n^2/N$; and first charge transfer device convolution means having a complex impulse response of EXP$j\ n^2/N$ for convolving said premultiplied speech samples to produce said $S_2(\omega)$ signals;

23. Apparatus according to claim 22 wherein said first and second convolution means are each comprised of four charge transfer device transversal filters.

24. Apparatus according to claim 23 wherein said four charge transfer device transversal filters include two charged transfer device transversal filters having impulse response of $COS(\pi n^2/N)$ and two transfer device transversal filters having an impulse response of $SIN(\pi n^2/N)$.

25. Apparatus according to claim 24 wherein each of the said transversal filters has $M \times N$ stages which are grouped in M blocks of N stages, each of said blocks having an identical impulse response, for generating a convolution representing the average of said M impulse responses.

26. Apparatus according to claim 24 wherein said charge transfer device transversal filters each include an N stage charge transfer device and an analog $2 \times 1$ switch, said delay line having an input coupled to a first input on said $2 \times 1$ switch and having an output coupled to a second input on said $2 \times 1$ switch, said $2 \times 1$ switch having an output coupled to the input of said transversal filter.

27. Apparatus according to claim 24 wherein said transversal filters are comprised of N stage for computing a sliding discrete transform.

28. Apparatus according to claim 24 wherein each of said premultiplication means are comprised of charge transfer device transversal filter means having an impulse response of said factors for generating analog electrical signals representing said factors.

* * * * *